US009767636B2

(12) United States Patent
Visser

(10) Patent No.: US 9,767,636 B2
(45) Date of Patent: Sep. 19, 2017

(54) GAMING APPARATUS AND METHOD INCLUDING OVERSIZED SYMBOLS

(75) Inventor: Antoon Christiaan Visser, Coogee (AU)

(73) Assignee: ARISTOCRAT TECHNOLOGIES AUSTRALIA PTY LIMITED, North Ryde (AU)

( * ) Notice: Subject to any disclaimer, the term of this patent is extended or adjusted under 35 U.S.C. 154(b) by 1075 days.

(21) Appl. No.: 12/239,490

(22) Filed: Sep. 26, 2008

(65) Prior Publication Data

US 2009/0117983 A1 May 7, 2009

(30) Foreign Application Priority Data

Sep. 27, 2007 (AU) ..... 2007905312

(51) Int. Cl.
*G07F 17/32* (2006.01)
*G07F 17/34* (2006.01)

(52) U.S. Cl.
CPC ..... *G07F 17/32* (2013.01); *G07F 17/326* (2013.01); *G07F 17/34* (2013.01)

(58) Field of Classification Search
CPC .. G07F 17/32; G07F 17/3262; G07F 17/3267; G07F 17/34; G07F 17/3213; G07F 17/326
USPC ..... 463/31, 33
See application file for complete search history.

(56) References Cited

U.S. PATENT DOCUMENTS 7,195,559 B2 3/2007 Gilmore et al.
2001/0009865 A1* 7/2001 Demar et al. ..... 463/20
2004/0023714 A1 2/2004 Asdale
2004/0048646 A1* 3/2004 Visocnik ..... 463/16
2005/0026679 A1* 2/2005 Lucchesi et al. ..... 463/20
2005/0288093 A1 12/2005 Englman et al.
2006/0046830 A1* 3/2006 Webb ..... G07F 17/3213 463/20
2007/0018406 A1* 1/2007 Kennedy ..... 273/307
2008/0242404 A1* 10/2008 Aoki ..... 463/26
2009/0061984 A1* 3/2009 Yi ..... 463/20

FOREIGN PATENT DOCUMENTS

AU 724039 9/2000
AU 771762 4/2004
AU 2007203467 2/2008

OTHER PUBLICATIONS

Paradi, Dave, "Using Animation and Slide Transition Effects on Presentation Slides", Aug. 19, 2006, available at <http://replay.web.archive.org/20060819163908/http://www.thinkoutsidetheslide.com/articles/using_animation_and_transition.htm>.*
Veer, E.A. Vander "PowerPoint 2007", Dec. 22, 2006, Chapter 11.*

* cited by examiner

*Primary Examiner* — Werner Garner
(74) *Attorney, Agent, or Firm* — Armstrong Teasdale LLP

(57) ABSTRACT

A method of game play, where a gaming machine is arranged to select symbols, and present the symbols on a display. In the method, successive arrays of symbols are displayed in a display area of the display, the symbols being drawn from a set of symbols that includes at least one special symbol. If a displayed array satisfies an eligibility criterion, a resultant array is displayed by revealing at least one symbol obscured by one or more of the special symbols in the displayed array. An award is awarded if the symbols in the resultant array satisfy a winning criterion.

23 Claims, 7 Drawing Sheets

GAMING APPARATUS AND METHOD INCLUDING OVERSIZED SYMBOLS

CROSS-REFERENCE TO RELATED APPLICATIONS

The present application claims the benefit of priority to Australian Provisional Patent Application No. 2007905312, filed on Sep. 27, 2007, entitled "GAMING APPARATUS AND METHOD INCLUDING OVERSIZED SYMBOLS", which is herein incorporated by reference in its entirety.

FIELD OF THE INVENTION

The present invention generally relates to gaming machines and methods of gaming.

BACKGROUND OF THE INVENTION

With the increase of gambling at gaming venues has come increased competition between gaming venues to obtain a larger share of the total gambling spend. Gaming venue operators have therefore continuously looked for new variations and types of games in order to attract both new and return customers to their venues.

In response to this need, suppliers of gaming devices and systems have attempted to provide the sought-after variety, while still developing games that comply with the relevant regulations in the jurisdiction of the gaming venue operator. Suppliers of gaming devices therefore are faced with restrictions on the types of games and gaming machines that are allowable, both in terms of the prevailing regulations and in terms of providing a return on investment to the gaming venue operators.

SUMMARY OF THE INVENTION

According to a first aspect, the invention broadly resides in a method for use with a gaming machine that is arranged to select symbols, present the selected symbols on a display and award an award if a winning outcome occurs, the method including:

displaying successive arrays of symbols in a display area of the display, the symbols being drawn from a set of symbols that includes at least one special symbol;

if a displayed array satisfies an eligibility criterion, displaying a resultant array by revealing at least one symbol obscured by one or more of the special symbols in the displayed array; and awarding the award if the symbols in the resultant array satisfy a winning criterion.

Preferably the special symbol occupies a larger area of the display area than other symbols in the set.

The displayed arrays of symbols may include a set of spinning reels. Alternatively the arrays of symbols may include a set of dice. In other arrangements the arrays of symbols may include a set of cards.

The special symbol may, upon display, obscure a previously-displayed symbol in a displayed array.

The step of displaying the resultant array may include animating the special symbol to reveal the at least one obscured symbol.

The special symbol may consist of a grouping of special symbols.

According to a second aspect, the invention broadly resides in a method for use with a gaming machine that is arranged to select symbols, present the selected symbols on a display and award an award if a winning outcome occurs, the method including:

activating a plurality of spinning reels to present respective sequences of symbols in a display area of the display, at least one reel having an associated sequence that includes an oversized symbol occupying a larger area than other symbols in the sequence;

halting the spinning reels to display an array of symbols in the display area; and if symbols in the array match an eligibility criterion, presenting a resultant array by revealing a plurality of symbols obscured by one or more of the oversized symbols in the display area.

Preferably the oversized symbol has a height that matches a height of the display area. In one arrangement the eligibility criterion is satisfied if at least one of the spinning reels halts to display the entire oversized symbol within the display area.

The step of revealing symbols obscured by the oversized symbol may include causing an opacity of the oversized symbol to decrease such that the obscured symbols become visible.

Alternatively the step of revealing symbols obscured by the oversized symbol may include progressively removing portions of the oversized symbol to reveal the obscured symbols. Preferably an order in which the portions are removed is substantially random.

Alternatively the step of revealing symbols obscured by the oversized symbol may include animating the oversized symbol to move to reveal the obscured symbols.

In one arrangement the method includes animating the oversized symbol to reveal at least one underlying spinning reel. Preferably the method includes the further step of causing the at least one underlying spinning reel to spin and come to rest to display symbols in the resultant array.

The method may include the step of moving the special symbol if a portion of the special symbol is displayed in the display area of a halted spinning reel. Preferably the special symbol is moved such that the entire special symbol is displayed in the display area.

The method may include the step of prompting a user to provide an input to initiate the step of revealing the symbols obscured by the oversized symbol.

According to another aspect, the invention broadly resides in a gaming machine that provides a game in which a plurality of symbols are selected and presented on a display and if a winning combination occurs, the gaming machine awards an award, the gaming machine including a user interface in communication with a game controller that is operable to:

display successive arrays of symbols in a display area of the display, the symbols being drawn from a set of symbols that includes at least one special symbol;

if a displayed array satisfies an eligibility criterion, display a resultant array by revealing at least one symbol obscured by one or more of the special symbols in the displayed array; and awarding the award if the symbols in the resultant array satisfy a winning criterion.

According to a further aspect, the invention broadly resides in a gaming machine that provides a game in which a plurality of symbols are selected and presented on a display and if a winning combination occurs, the gaming machine awards an award, the gaming machine including a user interface in communication with a game controller that is operable to:

activate a plurality of spinning reels to present respective sequences of symbols in a display area of the display, at least one reel having an associated sequence that includes an oversized symbol occupying a larger area than other symbols in the sequence;

halt the spinning reels to display an array of symbols in the display area; and if symbols in the array match an eligibility criterion, present a resultant array by revealing a plurality of symbols obscured by one or more of the oversized symbols in the display area.

According to further aspects, the invention broadly resides in instructions executable by a game controller to implement the method as described in the immediately preceding paragraphs and to such instructions when stored in a storage medium readable by the game controller. Further aspects of the present invention and further embodiments of the aspects described in the preceding paragraphs will become apparent from the following description, given by way of example and with reference to the accompanying drawings.

BRIEF DESCRIPTION OF THE DRAWINGS

Embodiments of the present invention will now be described with reference to the figures, in which.

Figure 1:
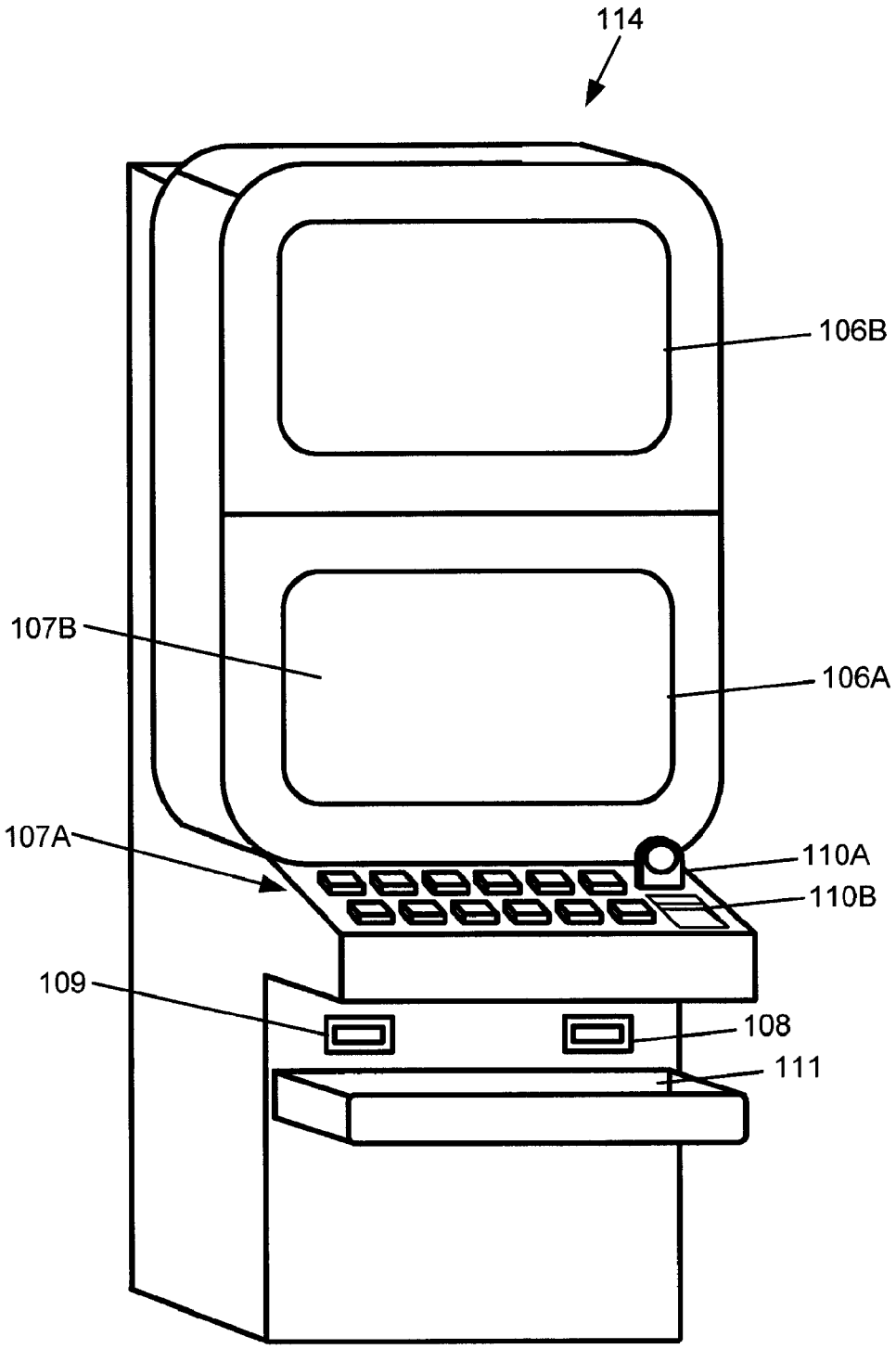
FIG. 1 shows schematically, a view of a gaming console suitable for implementing certain embodiments of the present invention.

The foregoing summary, as well as the following detailed description of certain embodiments of the present invention, will be better understood when read in conjunction with the appended drawings. For the purpose of illustrating the invention, certain embodiments are shown in the drawings. It should be understood, however, that the present invention is not limited to the arrangements and instrumentality shown in the attached drawings.

DETAILED DESCRIPTION OF THE EMBODIMENTS

In FIG. 1 of the accompanying drawings, one example of a gaming console that is suitable to implement certain embodiments of the present invention is generally referenced by arrow 114.

The gaming console 114 includes two displays 106A, 106B on one or both of which is displayed representations of a game that can be played by a player and a bank of buttons 107A and/or a touch screen 107B to enable a player to play the game. The displays 106 may be video display units, such as a cathode ray tube screen device, a liquid crystal display, plasma screen, any other suitable video display unit, or the visible portion of an electromechanical device. The display 106B may display artwork, including for example, pay tables and details of bonus awards and other information or images relating to the game. In alternative gaming consoles the display 106B may be omitted, optionally replaced by a static display.

A credit input including a coin input 110A and/or bill collector 110B allows a player to provide credit for wagering and a coin output 111 is provided for cash payouts from the gaming console 114. A card and/or ticket reader 108 and a printer 109 may be provided to provide player tracking, cashless game play or other gaming and non-gaming related functions.

Figure 2:
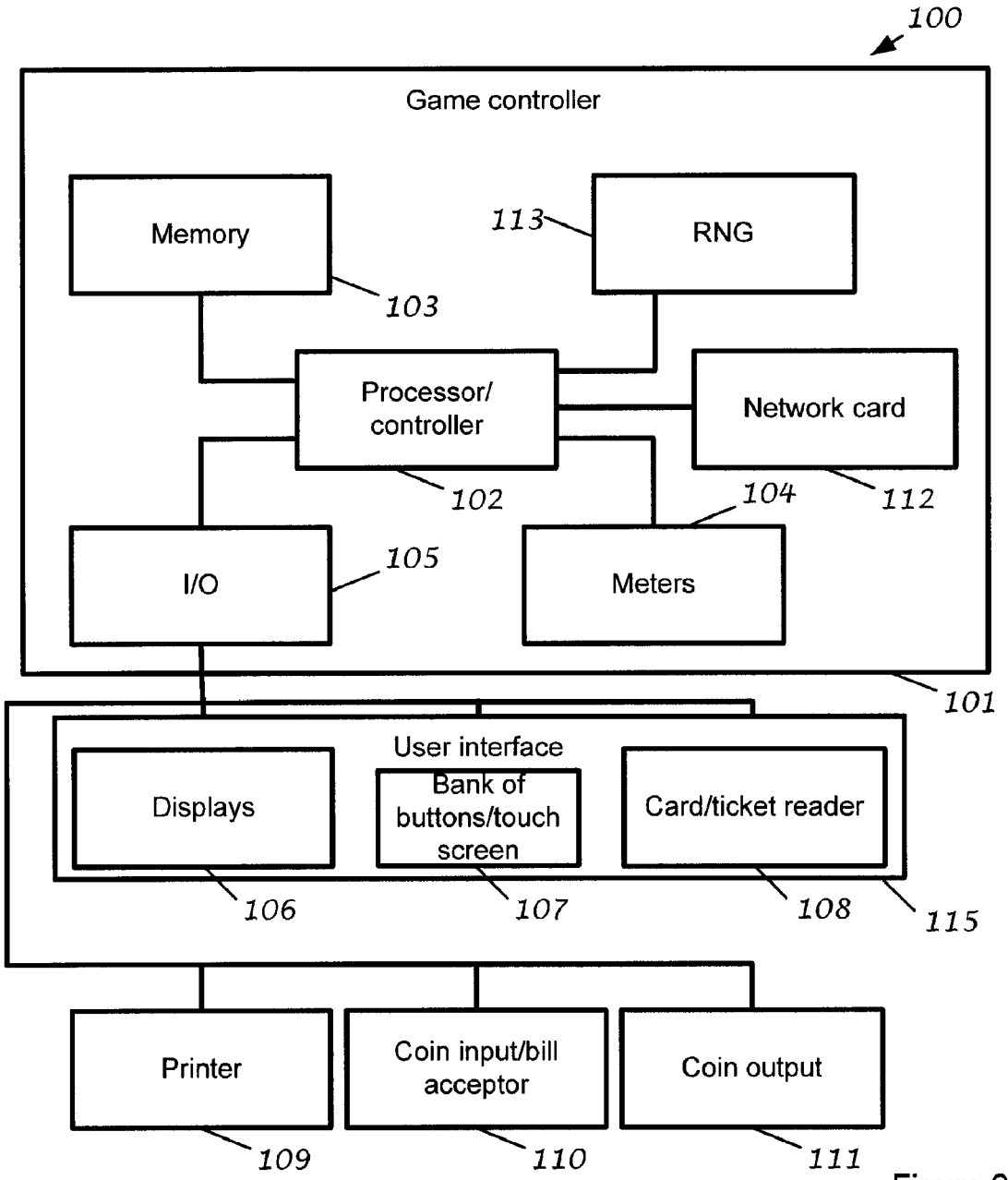
FIG. 2 shows a block diagram of gaming machine suitable for implementing certain embodiments of the present invention.

FIG. 2 shows a block diagram of a gaming machine, generally referenced by arrow 100, suitable for implementing certain embodiments of the present invention. The gaming machine 100 may include the gaming console 114 shown in FIG. 1 and accordingly like reference numerals have been used to describe like components in FIGS. 1 and 2.

The gaming machine 100 includes a game controller 101, which in the illustrated example includes a computational device 102, which may be a microprocessor, microcontroller, programmable logic device or other suitable device. Instructions and data to control operation of the computational device 102 are stored in a memory 103, which is in data communication with, or forms part of, the computational device 102. Typically, the gaming machine 100 will include both volatile and non-volatile memory and more than one of each type of memory, with such memories being collectively represented by the memory 103. The instructions to cause the game controller 101 to implement the present invention will be stored in the memory 103. The instructions and data for controlling operation of the computational device 102 may be stored on a computer readable medium from which they are loaded into the gaming machine memory 103. The instructions and data may be conveyed to the gaming machine via a data signal in a transmission channel. Examples of such transmission channels include network connections, the Internet or an intranet and wireless communication channels.

The game controller 101 may include hardware credit meters 104 for the purposes of regulatory compliance and also include an input/output (I/O) interface 105 for communicating with the peripheral devices of the gaming machine 100. The input/output interface 105 and/or the peripheral devices may be intelligent devices with their own memory for instructions and data.

In the example shown in FIG. 2, the peripheral devices that communicate with the controller are the displays 106, bank of buttons/touch screen 107, the card and/or ticket reader 108, the printer 109, a bill acceptor and/or coin input 110 and a coin output 111. Additional devices may be included as part of the gaming machine 100, or devices omitted based on the specific implementation.

The bank of buttons 107A and/or touch screen 107B together with one or both of the displays 106 may provide a user interface 115 through which the gaming machine 100 and player communicate. If a card/ticket reader 108 is provided, this may also form part of the user interface 115.

In addition, the gaming machine 100 may include a communications interface, for example a network card 112. The network card 112, may for example, send status information, accounting information or other information to a central controller, server or database and receive data or commands from the central controller, server or database. The network card 112 may also enable communication with a central player account, allowing cashless gaming. One or more of the peripheral devices, for example the card/ticket reader 108 may be able to communicate directly with the network card 112. The network card 112 and the I/O interface 105 may be suitably implemented as a single machine communications interface.

The game controller 101 may also include a random number generator 113, which generates a series of random numbers that are used by the computational device 102 to determine the outcomes of games played on the gaming machine 100.

The game controller 101 may have distributed hardware and software components that communicate with each other directly or through a network or other communication channel. The game controller 101 may also be located in part or in its entirety remote from the user interface 115. Also, the computational device 102 may include a plurality of devices, which may be local or remote from each other. Instructions and data for controlling the operation of the user interface 115 may be conveyed to the user interface 115 by means of a data signal in a transmission channel. The user interface 115 may be a computational device, for example a personal computer, used by a person to play a game provided from a remote game controller 101.

Figure 3:
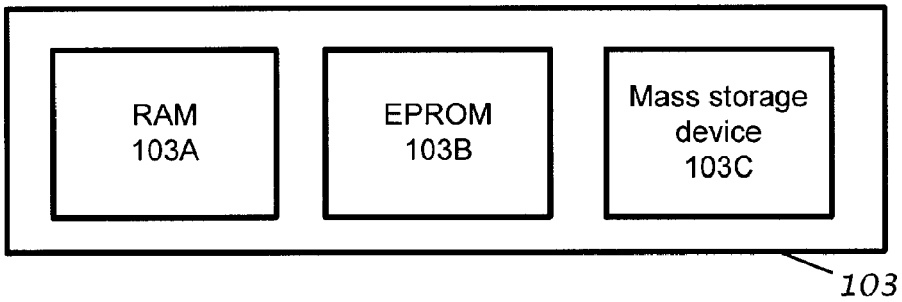
FIG. 3 shows a block diagram of components of the memory of the gaming machine represented in FIG. 2.

FIG. 3 shows an exemplary block diagram of the main components of the memory 103. The RAM 103A typically temporarily holds instructions and data related to the execution of game programs and communication functions performed by the computational controller 102. The EPROM 103B may be a boot ROM device and/or may contain system and game related code. The mass storage device 103C may be used to store game programs, the integrity of which may be verified and/or authenticated by the computational controller 102 using protected code from the EPROM 103B or elsewhere.

Figure 4:
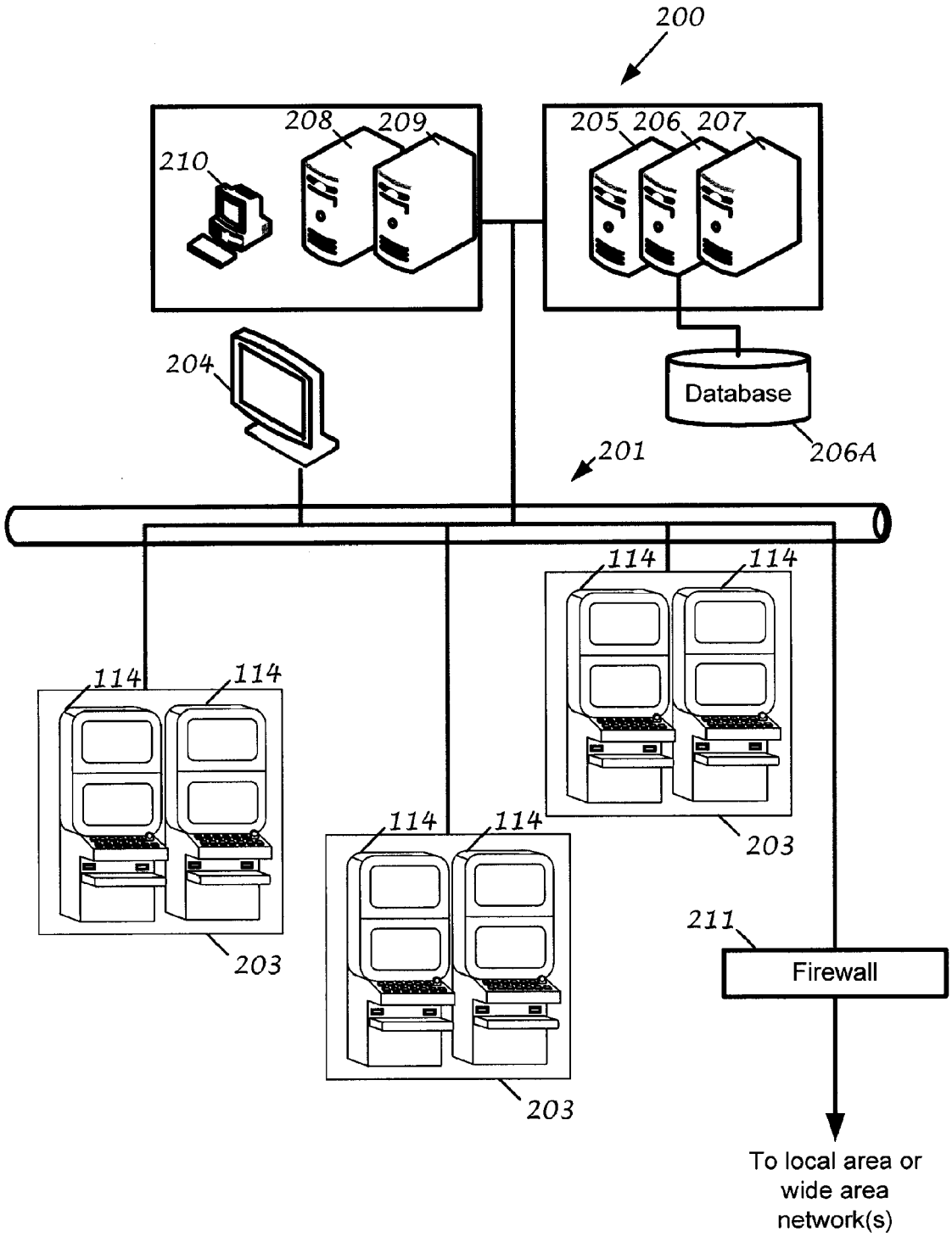
FIG. 4 shows schematically a network gaming system suitable for implementing certain embodiments of the present invention.

FIG. 4 shows a gaming system 200 in the form of a network of devices. The gaming system 200 includes a network infrastructure 201, which for example may be in the form of an Ethernet network. Alternatively, a wireless network and/or direct communication channels, or a different type of network may be used to link the gaming machines to a server, each other and/or other devices. Gaming consoles 114, shown arranged in three banks 203 of two gaming consoles 114 in FIG. 4, are connected to the network infrastructure 201. The gaming consoles 114 may form part or all of a gaming machine 100. Single gaming consoles 114 and banks 203 containing three or more gaming consoles 114 may also be connected to the network infrastructure 201, which may also include bank controllers, hubs, routers, bridges to other networks and other devices (not shown).

One or more displays 204 may also be connected to the network 201. The displays 204 may, for example, be associated with a bank 203 of gaming consoles 114. The displays 204 may be used to display representations associated with game play on the gaming consoles 114, and/or used to display other representations, for example promotional or informational material.

Servers may also be connected to the network 201. For example, a game server 205 may generate game outcomes for games played on one or more of the gaming consoles 114, a database management server 206 may manage the storage of game programs and associated data in a database 206A so that they are available for downloading to, or access by, game controllers 101, and a jackpot server 207 may control one or more jackpots for the gaming system 200.

Further servers may be provided to assist in the administration of the gaming system 200, including for example a gaming floor management server 208, and a licensing server 209 to monitor the use of licenses to particular games. An administrator terminal 210 is provided to allow an administrator to manage the network 201 and the devices connected to the network. The different servers depicted can be distinct physical servers or logically distinct server processes running on a single physical server.

The gaming system 200 may communicate with other gaming systems, other local networks, for example a corporate network and/or a wide area network such as the Internet through a firewall 211.

Figure 5:
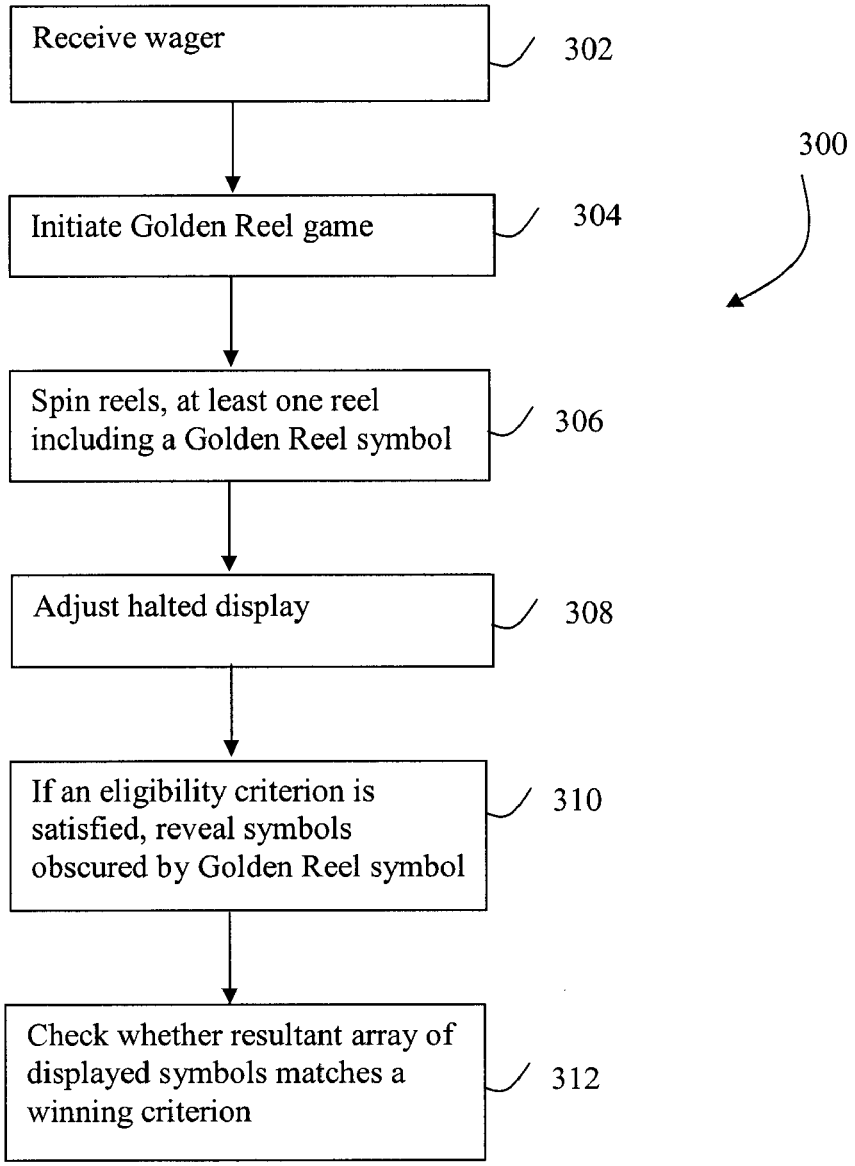
FIG. 5 shows a flow diagram of a process performed in accordance with an embodiment of the present invention.

FIG. 5 shows a process flow diagram of a process performed in accordance with an embodiment of the present invention. The process may be performed by the gaming system 200, in which the gaming consoles 114 each include game controllers 101 to form gaming machines 100 and the following description assumes this implementation. However, those skilled in the relevant arts will appreciate that the process will also be able to be implemented by other gaming systems.

In step 302 of process 300, the game controller 101 monitors the bill acceptor and/or coin input 110 and/or information received by the card/ticket reader 108 or network card 112 for a deposit of credit and in response causes the hardware meters 104 to increment according to the denomination of the game. The game controller 101 then monitors the user interface 107 for the input of a wager.

If there are sufficient credits in the meters 104 to support the wager, a game play is commenced by the game controller 101.

Certain embodiments of the present application describe a feature, initiated in process 304, that in one embodiment involves a Golden Reel symbol. In some arrangements, the feature may be available for all games and all wagers placed on the gaming machine 100. Alternatively, the feature described herein may only be available for eligible bets and/or eligible games. Eligibility may be determined using various known methods including suitable ante-bets or trigger events in a base game which commence one or more free games. In one example, the underlying game is a spinning reel game. If a specified symbol is displayed, the Golden Reel game described herein may be triggered.

In one embodiment, the Golden Reel game initiated in process 304 involves a plurality of spinning reels. Each spinning reel has an associated sequence of symbols that are displayed in a display area on displays 106. For example, the display area may show an array of symbols having five rows and three columns. That is, each of five spinning reels may show up to three symbols at a time.

Figure 6A:
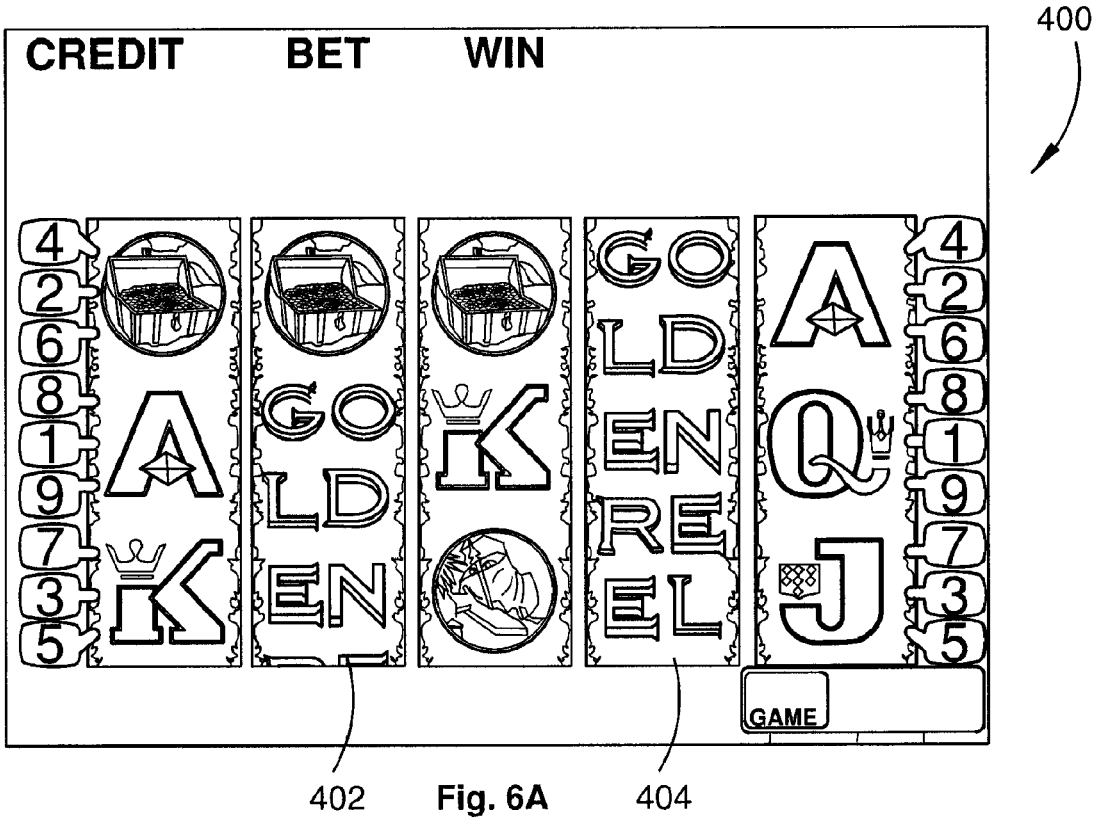
FIG. 6A shows an example of a screen display from a spinning reel game including Golden Reel symbols on two reels.
Figure 6B:
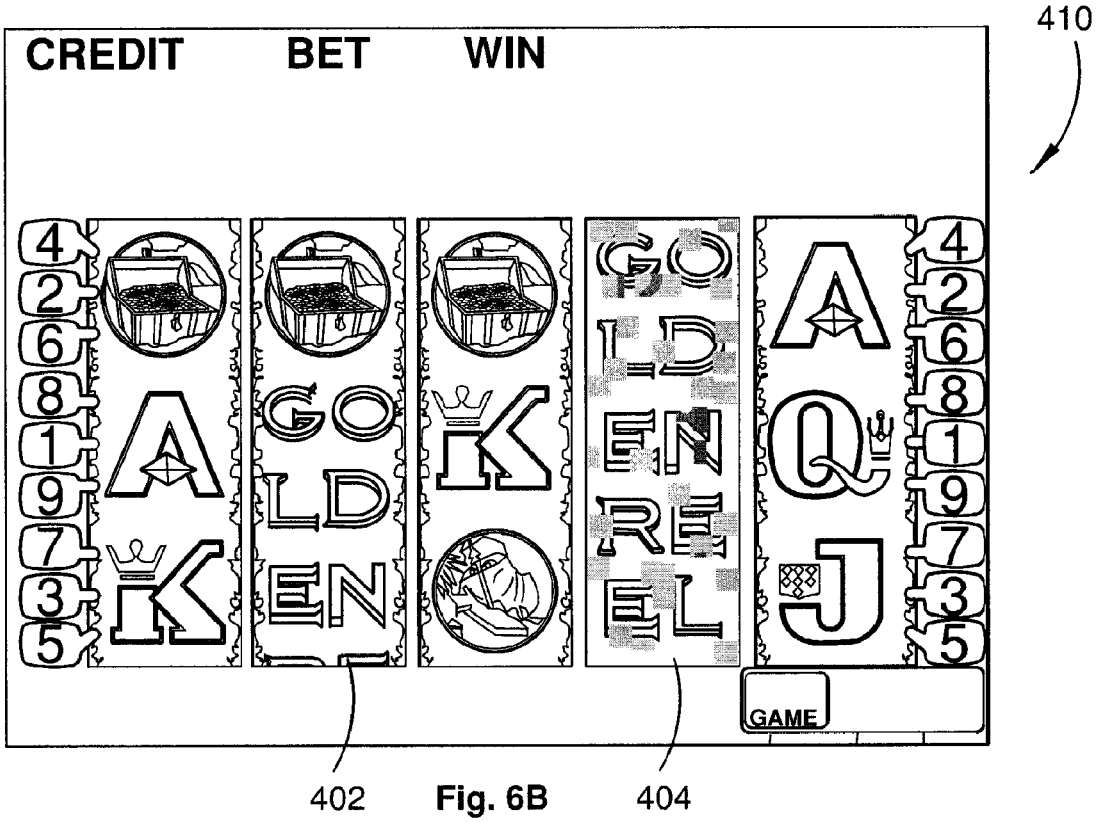
FIG. 6B shows an example of a screen display in which a Golden Reel symbol dithers away to reveal symbols hidden beneath.

In process 306, the reels are animated to give the impression of the reels spinning in the display area. The sequence of symbols associated with at least one of the spinning reels includes an oversized Golden Reel symbol. Preferably, the height of the Golden Reel matches the height of the display area. An example is shown in FIG. 6A, in which a screen display 400 includes five spinning reels, each showing up to three symbols in the display area. Reels 402 and 404 have associated sequences of symbols that include at least one Golden Reel symbol. As may be seen in the display of reel 404, the Golden Reel symbol corresponds to the height of the display area and is equivalent to three symbols of ordinary size.

In process 306, the symbols are spun either simultaneously or sequentially. The reels are halted to display an array of symbols in the display area.

In some arrangements, the displayed array may be adjusted in process 308 once the reel stops spinning. For example, in screen display 400, reel 402 has come to a halt with the Golden Reel symbol occupying two symbol spaces while a treasure chest symbol is shown in the remaining symbol space of reel 402. In one arrangement, the reel 402 is nudged such that the Golden Reel symbol occupies all three symbol spaces. In an alternative arrangement, the Golden Reel symbol may be flanked by a WILD symbol above and/or below the Golden Reel. In another alternative, if a Golden Reel symbol does not occupy the entire reel space in the display area, the Golden Reel will pay as a scatter times 1 on the reels on which it is displayed.

The oversized Golden Reel symbol is distinctive and eye-catching and a player viewing the display area may be aware of the Golden Reel symbol spinning past due to its size and colouring. The Golden Reel symbol may be a single symbol or a distinctive grouping of symbols. Clearly, in one arrangement, the Golden Reel symbol has a golden colour. However, this is not limiting and other colours may also be used.

In process 310, after the reels have come to a halt, if an eligibility criterion is satisfied, the special symbol is animated to reveal a plurality of previously-obscured symbols. An example of an eligibility criterion is that at least one reel has come to a halt displaying an entire Golden Reel symbol filling the display area of the reel. Additional or alternative eligibility criteria may be used. For example, the player may be required to pay an additional amount for the Golden Reel to reveal the obscured symbols. The player may be prompted to give an input before the Golden Reel reveals the obscured symbols, for example by touching a button or touch screen in the user interface 107.

There are various ways in which the Golden Reel may be animated in process 310 to reveal the underlying symbols. For example, the Golden Reel may fade away to show underlying symbols. The software driving the display 106 may achieve this by varying the opacity of graphic objects rendered to the display 106 to represent the spinning reel. To cause the Golden Reel to fade away, its opacity may be progressively reduced until the underlying graphic objects are visible.

An alternative is to have the Golden Reel symbol "dither" away. In this approach small areas of the Golden Reel may be removed to show a portion of the underlying graphic object. As more parts of the Golden Reel are removed, an increasing proportion of the underlying object becomes visible until the entire underlying objects can be seen. The small areas of the Golden Reel may be removed in a random order.

Other animation techniques may be used to reveal the symbols beneath the Golden Reel. For example, the Golden Reel symbol may open up like a pair of saloon doors. The Golden Reel symbol could also roll up like a blind.

In one arrangement, the symbols revealed beneath the Golden Reel symbol consist exclusively of WILD and PIC-1 symbols. PIC-1 symbols are symbols associated with the highest award for all the picture symbols excluding wild and scatter symbols. PIC-1 symbols may have the effect of increasing the value of awards made in the game.

The symbols obscured by the Golden Reel symbol may be regarded as symbols on a reel within a reel. That is, there is an outer reel having a sequence of symbols that includes the Golden Reel symbol. The symbols revealed when the Golden Reel fades away are selected at random and may be regarded as symbols from a sequence associated with one or more subsidiary reels. In one arrangement, the sequence of symbols associated with this hidden subsidiary reel consists solely of WILD and PIC-1 symbols.

In one arrangement, once the Golden Reel has faded or dithered away, the underlying hidden reel spins and halts to reveal a plurality of symbols. The underlying reel may start to spin while the Golden Reel is fading.

In process 312, the controlling software determines whether the resultant array of symbols displayed in the display area of display 106 matches a winning criterion. If so, an award may be made. In one arrangement the Golden Reel symbol is inoperative by itself in the assessment of winning criteria. However, the symbols revealed by the Golden Reel are used in the assessment of the winning criteria.

FIGS. 6A-9 show some examples of screen displays from Golden Reel games. FIG. 6A shows a screen display 400 having five spinning reels, each of which may show up to three symbols in the display area. The display 400 arises at the end of process 306 in which the reels have been spun and halted. Two Golden Reel symbols are displayed, on reels 402 and 404 respectively. The Golden Reel symbol on reel 404 occupies the entire display area. The Golden Reel symbol on reel 402 has halted to only occupy two thirds of the display area. In the illustrated example, the display is not adjusted to shift the reel symbol on reel 402, and accordingly, only the Golden Reel on reel 404 satisfies the eligibility criterion. The screen display 410 seen in FIG. 6B illustrates the Golden Reel symbol on reel 404 dithering away to reveal three underlying symbols. Display 410 shows the process at an intermediate point in which portions of the Golden Reel symbol are still visible, together with portions of the underlying symbols.

Figure 7:
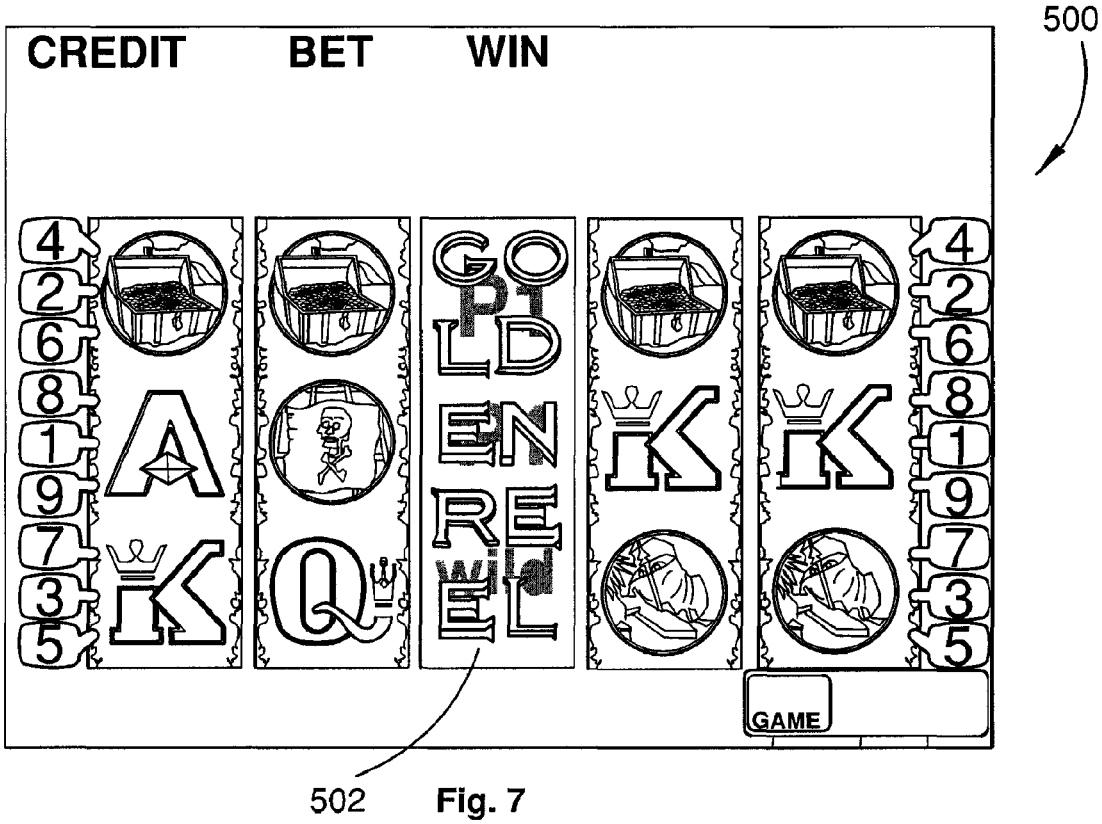
FIG. 7 shows an example of a screen display from a game in which a Golden Reel symbol fades away to reveal underlying symbols.

FIG. 7 shows a screen display 500 in which a single Golden Reel symbol has been spun up on the central reel 502 to occupy the entire display area of the reel. The displayed Golden Reel symbol is fading away to show three underlying symbols, which are P1, P1 and wild respectively. The illustrated screen display 500 is at an intermediate point at which both the Golden Reel symbol and the underlying symbols are visible simultaneously. As the process continues, the opacity of the Golden Reel symbol is further reduced.

Figure 8:
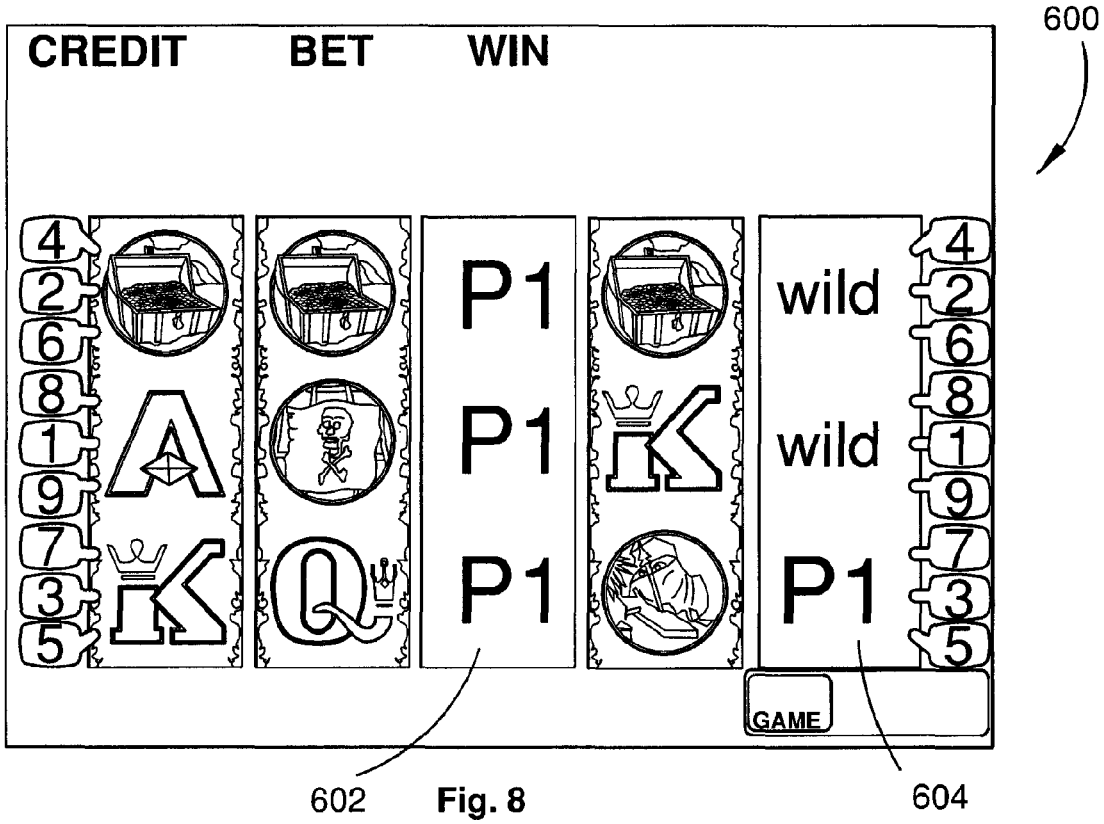
FIG. 8 shows a further example of a screen display of a game with two Golden Reels revealing underlying symbols.

FIG. 8 shows a screen display 600 in an example where two Golden Reels have been spun up on reels 602 and 604 respectively. The Golden Reels have been animated to reveal the underlying hidden reels which contain P1 and WILD symbols. The two underlying reels have been spun and halted. The resultant display for reel 602 consists of three P1 symbols, while the resultant display for reel 604 includes two wilds and one P1 symbol.

Figure 9:
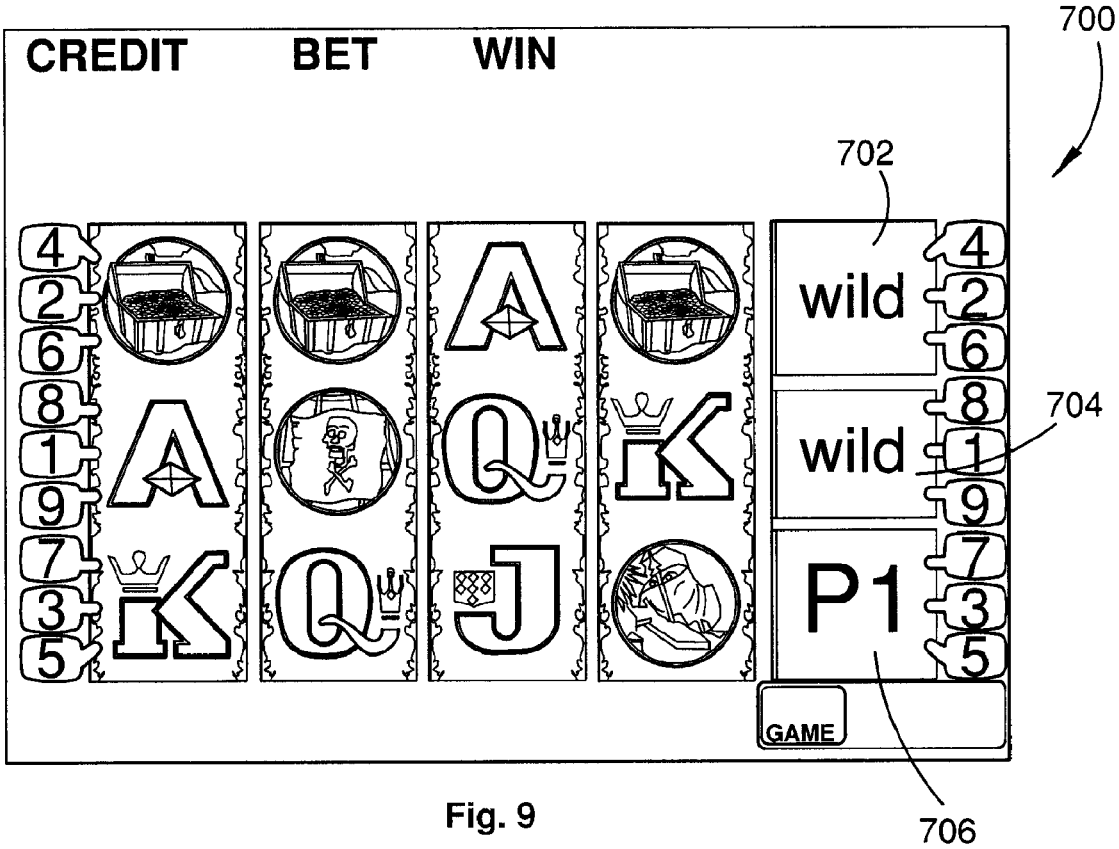
FIG. 9 shows an example of a game in which a Golden Reel symbol reveals three smaller underlying reels.

FIG. 9 shows a further example in which a Golden Reel symbol is animated to reveal three smaller underlying reels, each of which may be spun individually. In the example of FIG. 9, an oversized Golden Reel symbol has been displayed on reel 700. The oversized Golden Reel symbol has been animated to reveal three underlying reels 702, 704 and 706. Each of these reels has been spun to show the resultant display of two wilds and a P1 symbol respectively.

In the described arrangements, special symbols or oversized symbols effectively obscure underlying symbols. The process of revealing the obscured symbols may increase a sense of anticipation for a player and add to the excitement of the game. In the spinning reel embodiments, the special or oversized symbols are preferably visible as they spin past the player and this visible movement may also add to the excitement and anticipation of the game.

The foregoing embodiments relate to spinning reel games. The concepts may be also be used in card games and dice games presented on a gaming machine such as gaming machine 114.

In one example, a card game displayed on a display 106 of a gaming machine 114 may include at least one Golden Card. The Golden Card may be an oversized card that obscures one or more underlying cards. The Golden Card may be a standard-sized card or group of standard-sized cards with no number or suit or other indicia other than a distinguishing colour (which is gold in the described example).

In a game that uses multiple hands of cards which are usually displayed one above the other, the Golden Card may be an oversized card covering several hands.

One or more Golden Cards may be added to a group of cards from which the random number generator 113 makes a selection. The Golden Card may be available for all games and wagers. Alternatively, the feature may only be available for eligible bets and/or eligible games, as described above for the Golden Reel games.

The cards may be selected for display using standard techniques. For example, in a standard pack of cards there are 52 cards and the Golden Card may be added but have only 1 chance in 105 of being selected (ie the array of displayed cards is selected from 2 decks plus 1 Golden Card).

In the case where the Golden Card is oversized, if the Golden Card is selected and displayed it may obscure cards in more than one hand of the displayed card game. A Golden Card may thus obscure a previously-displayed card in another hand. In this case the previously-displayed card may be overridden and replaced with a selection dependent on the Golden Card.

When a Golden Card has been selected and displayed it may change into a different card or change adjoining cards into different cards. The Golden Card may fade or dither or animate to reveal the different card.

In a dice game one or more Golden Dice may be included, having no indicia on the sides, and being distinguished by a golden colour. The Golden Dice may be standard size dice which open to reveal one or more dice within. In one arrangement the revealed die may have either a 5 or 6 on each of the sides. The Golden Die may be oversized and animate to reveal one or more dice.

The Golden Die may have additional faces. For example, although the regular dice have 6 faces, the Golden Die may have 12 faces and open to reveal 2 additional die.

The Golden Die may be selected in the usual way with the golden die added to the group of die from which the random number generator 113 makes a selection. In a feature game, the Golden Die might always be one of the selected die or might have a greater chance of selection.

The Golden Card and Golden Die may be animated if there is a chance of forming or improving a winning hand.

While the foregoing description has been provided by way of example of the preferred embodiments of the present invention as presently contemplated, which utilise gaming machines of the type found in casinos, those skilled in the relevant arts will appreciate that the present invention also may have application to internet gaming and/or have application to gaming over a telecommunications network, where handsets are used to display game outcomes and receive player inputs.

Where in the foregoing description reference has been made to integers having known equivalents, then those equivalents are hereby incorporated herein as if individually set forth.

Those skilled in the relevant arts will appreciate that modifications and additions to the embodiments of the present invention may be made without departing from the scope of the present invention.

It will be understood that the invention disclosed and defined in this specification extends to all alternative combinations of two or more of the individual features mentioned or evident from the text or drawings. All of these different combinations constitute various alternative aspects of the invention.

It will also be understood that the term "comprises" (or its grammatical variants) as used in this specification is equivalent to the term "includes" and should not be taken as excluding the presence of other elements or features.

Several embodiments are described above with reference to the drawings. These drawings illustrate certain details of specific embodiments that implement the systems and methods and programs of the present invention. However, describing the invention with drawings should not be construed as imposing on the invention any limitations associated with features shown in the drawings. The present invention contemplates methods, systems and program products on any electronic device and/or machine-readable media suitable for accomplishing its operations. Certain embodiments of the present invention may be implemented using an existing computer processor and/or by a special purpose computer processor incorporated for this or another purpose or by a hardwired system, for example.

Embodiments within the scope of the present invention include program products comprising machine-readable media for carrying or having machine-executable instructions or data structures stored thereon. Such machine-readable media can be any available media that can be accessed by a general purpose or special purpose computer or other machine with a processor. By way of example, such machine-readable media may comprise RAM, ROM, PROM, EPROM, EEPROM, Flash, CD-ROM or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor. When information is transferred or provided over a network or another communications connection (either hardwired, wireless, or a combination of hardwired or wireless) to a machine, the machine properly views the connection as a machine-readable medium. Thus, any such a connection is properly termed a machine-readable medium. Combinations of the above are also included within the scope of machine-readable media. Machine-executable instructions comprise, for example, instructions and data which cause a general purpose computer, special purpose computer, or special purpose processing machines to perform a certain function or group of functions.

Method steps associated with certain embodiments may be implemented in one embodiment by a program product including machine-executable instructions, such as program code, for example in the form of program modules executed by machines in networked environments. Generally, program modules include routines, programs, objects, components, data structures, etc., that perform particular tasks or implement particular abstract data types. Machine-executable instructions, associated data structures, and program modules represent examples of program code for executing steps of the methods disclosed herein. The particular sequence of such executable instructions or associated data structures represents examples of corresponding acts for implementing the functions described in such steps.

The invention claimed is:

1. A method for use with a gaming machine that is arranged to select symbols, present the selected symbols on a display in respective ones of a first plurality of symbol positions, and award an award if a winning outcome occurs, the gaming machine including a player interface, a game controller, and an acceptor that receives a physical item representing a monetary value, the method comprising:

receiving, by the acceptor, credit input by a player for contribution to a credit balance associated with the player, the credit balance stored by a hardware meter associated with the gaming machine;

receiving, by the game controller, a wager input by the player using the player interface to initiate a gaming session;

displaying, by the game controller, the first plurality of symbol positions in successive arrays on a plurality of spinning reel columns each having a plurality of rows in a display area of the display, the respective first plurality of symbol positions each displaying a symbol that is drawn from a set of symbols that includes at least one special symbol, the at least one special symbol having a size that occupies an entire visible display area of at least one of the plurality of spinning reel columns;

determining, by the game controller, whether a displayed array satisfies an eligibility criterion, the eligibility criterion including a completed display of the entire at least one special symbol within the entire visible display area of at least one of the plurality of spinning reel column;

when the displayed array satisfies the eligibility criterion, displaying, by the game controller, a resultant array by revealing a second plurality of symbol positions within the at least one spinning reel column obscured by one or more of the at least one special symbol in the displayed array, wherein revealing the second plurality of symbol positions obscured by the one or more of the at least one special symbol comprises progressively removing portions of the one or more of the at least one special symbol to reveal the second plurality of symbol positions obscured by the one or more of the at least one special symbol;

selecting, by the game controller, from the set of symbols, at least one symbol to be displayed in each of the revealed second plurality of symbol positions of the at least one spinning reel column in response to the second plurality of symbol positions being revealed; and crediting, by the game controller, the credit balance stored by the hardware meter and associated with the player with a payout if the symbols in the resultant array satisfy a winning criterion.

2. The method of claim 1, wherein the at least one special symbol occupies a larger area of the display area than other symbols in the set of symbols.

3. The method of claim 1, wherein the displayed arrays of symbols comprise a set of dice.

4. The method of claim 1, wherein the arrays of symbols comprise a set of cards.

5. The method of claim 1, wherein the at least one special symbol obscures a previously displayed symbol in the displayed array.

6. The method of claim 1, wherein displaying the resultant array comprises animating the at least one special symbol to reveal the second plurality of symbol positions.

7. The method of claim 1, wherein the at least one special symbol consists of a grouping of special symbols.

8. A method for use with a gaming machine that is arranged to select symbols, present the selected symbols on a display in respective ones of a first plurality of symbol positions, and award an award if a winning outcome occurs, the gaming machine including a player interface, a game controller, and an acceptor that receives a physical item representing a monetary value, the method comprising:

receiving, by the acceptor, credit input by a player for contribution to a credit balance associated with the player, the credit balance stored by a hardware meter associated with the gaming machine;

receiving, by the game controller, a wager input by the player using the player interface to initiate a gaming session;

activating, by the game controller, a plurality of reels to spin to present respective sequences of symbols in a display area of the display, each of the plurality of reels including a plurality of rows in the display area, at least one reel of the plurality of reels having an associated sequence that includes an oversized symbol having a size that occupies an entire visible display area of at least one of the plurality of reels;

halting, by the game controller, the spinning reels to display the first plurality of symbol positions in an array in the display area, the respective first plurality of symbol positions each displaying a symbol that is drawn from a set of symbols that includes at least one oversized symbol;

determining, by the game controller, whether the displayed array satisfies an eligibility criterion, the eligibility criterion including a completed display of the entire at least one oversized symbol within the entire visible display area of the at least one of the plurality of reels;

when the symbols in the array match the eligibility criterion, presenting, by the game controller, a resultant array by revealing a second plurality of symbol positions within the at least one reel obscured by the at least one oversized symbol in the display area, wherein revealing the second plurality of symbol positions obscured by the at least one oversized symbol comprises progressively removing portions of the at least one oversized symbol to reveal the second plurality of symbol positions obscured by the at least one oversized symbol; and crediting, by the game controller, the credit balance stored by the hardware meter and associated with the player with a payout if the symbols in the resultant array satisfy a winning criterion.

9. The method of claim 8, wherein the at least one oversized symbol has a height that matches a height of the display area.

10. The method of claim 8, wherein revealing the second plurality of symbol positions obscured by the at least one oversized symbol comprises causing an opacity of the at least one oversized symbol to decrease such that the second plurality of symbol positions becomes visible.

11. The method of claim 8, wherein the portions are removed in substantially random order.

12. The method of claim 8, wherein revealing the second plurality of symbol positions obscured by the at least one oversized symbol may comprise animating the at least one oversized symbol to move to reveal the second plurality of symbol positions.

13. The method of claim 8, wherein the method further comprises animating the at least one oversized symbol to reveal at least one underlying spinning reel.

14. The method of claim 13, wherein the method further comprises causing the at least one underlying spinning reel to spin and come to rest to display symbols in the resultant array.

15. The method of claim 8, wherein the method further comprises moving the at least one oversized symbol if a portion of the at least one oversized symbol is displayed in the display area of a halted spinning reel.

16. The method of claim 15, wherein the at least one oversized symbol is moved such that the entire at least one oversized symbol is displayed in the display area.

17. The method of claim 8, wherein the method further comprises prompting the player to provide an input to initiate the revealing the second plurality of symbol positions obscured by the at least one oversized symbol.

18. A gaming machine that provides a game in which a plurality of symbols are selected and presented on a display in respective ones of a first plurality of symbol positions, and if a winning combination occurs, the gaming machine awards an award, the gaming machine comprising a player interface and an acceptor that receives a physical item representing a monetary value in communication with a game controller that is operable to:

receive, via the acceptor, credit input by a player for contribution to a credit balance associated with the player, the credit balance stored by a hardware meter associated with the gaming machine;

receive a wager input by the player using the player interface to initiate a gaming session;

display the first plurality of symbol positions in successive arrays on a plurality of spinning reel columns each having a plurality of rows in a display area of the display, the respective first plurality of symbol positions each displaying a symbol that is drawn from a set of symbols that includes at least one special symbol, the at least one special symbol having a size that occupies an entire visible display area of at least one of the plurality of spinning reel columns;

determine whether a displayed array satisfies an eligibility criterion, the eligibility criterion including a completed display of the entire at least one special symbol within the entire visible display area of at least one of the plurality of spinning reel columns;

when the displayed array satisfies the eligibility criterion, display, by the game controller, a resultant array by revealing a second plurality of symbol positions within the at least one spinning reel column obscured by one or more of the at least one special symbol in the displayed array, wherein revealing the second plurality of symbol positions obscured by the one or more of the at least one special symbol comprises progressively removing portions of the one or more of the at least one special symbol to reveal the second plurality of symbol positions obscured by the one or more of the at least one special symbol;

select, from the set of symbols, at least one symbol to be displayed in each of the revealed second plurality of symbol positions of the at least one spinning reel column in response to the second plurality of symbol positions being revealed; and credit the credit balance stored by the hardware meter and associated with the player with a payout if the symbols in the resultant array satisfy a winning criterion.

19. A gaming machine that provides a game in which a plurality of symbols are selected and presented on a display in respective ones of a first plurality of symbol positions, and if a winning combination occurs, the gaming machine awards an award, the gaming machine comprising a player interface and an acceptor that receives a physical item representing a monetary value in communication with a game controller that is operable to:

receive, via the acceptor, credit input by a player for contribution to a credit balance associated with the player, the credit balance stored by a hardware meter associated with the gaming machine;

receive a wager input by the player using the player interface to initiate a gaming session;

activate a plurality of reels to spin to present respective sequences of symbols in a display area of the display, each of the plurality of reels including a plurality of rows in the display area, at least one reel of the plurality of reels having an associated sequence that includes an oversized symbol having a size that occupies an entire visible display area of at least one of the plurality of reels;

halt the spinning reels to display the first plurality of symbol positions in an array in the display area, the first respective plurality of symbol positions each displaying a symbol that is drawn from a set of symbols that includes at least one oversized symbol;

determine whether the displayed array satisfies an eligibility criterion, the eligibility criterion including a completed display of the entire at least one oversized symbol within the entire visible display area of the at least one of the plurality of reels;

when symbols in the array match the eligibility criterion, presenting a resultant array by revealing a second plurality of symbol positions within the at least one reel obscured by the at least one oversized symbol in the display area, wherein revealing the second plurality of symbol positions obscured by the at least one oversized symbol comprises progressively removing portions of the at least one oversized symbol to reveal the second plurality of symbol positions obscured by the at least one oversized symbol; and credit the credit balance stored by the hardware meter and associated with the player with a payout if the symbols in the resultant array satisfy a winning criterion.

20. An electronic storage device for communicating with a game controller of a gaming system, the electronic storage device storing instructions readable and/or executable by the game controller to implement a method for use with the gaming machine that is arranged to select symbols, present the selected symbols on a display in respective ones of a first plurality of symbol positions, and award an award if a winning outcome occurs, the method comprising:

receiving, by an acceptor that receives a physical item representing a monetary value, credit input by a player for contribution to a credit balance associated with the player, the credit balance stored by a hardware meter associated with the gaming system;

receiving, by the game controller, a wager input by the player using a player interface to initiate a gaming session;

displaying the first plurality of symbol positions in successive arrays on a plurality of spinning reel columns each having a plurality of rows in a display area of the display, the respective first plurality of symbol positions each displaying a symbol that is drawn from a set of symbols that includes at least one special symbol, the at least one special symbol having a size that occupies an entire visible display area of at least one of the plurality of spinning reel columns;

determining, by the game controller, whether a displayed array satisfies an eligibility criterion, the eligibility criterion including a completed display of the entire at least one special symbol within the entire visible display area of at least one of the plurality of spinning reel column;

when the displayed array satisfies the eligibility criterion, displaying, by the game controller, a resultant array by revealing a second plurality of symbol positions within the at least one spinning reel column obscured by one or more of the at least one special symbol in the displayed array, wherein revealing the second plurality of symbol positions obscured by the one or more of the at least one special symbol comprises progressively removing portions of the one or more of the at least one special symbol to reveal the second plurality of symbol positions obscured by the one or more of the at least one special symbol;

selecting, by the game controller, from the set of symbols, at least one symbol to be displayed in each of the revealed second plurality of symbol positions of the at least one spinning reel column in response to the second plurality of symbol positions being revealed; and crediting the credit balance stored by the hardware meter and associated with the player with a payout if the symbols in the resultant array satisfy a winning criterion.

21. A non-transitory computer program product comprising machine-readable code recorded on a machine-readable medium, for controlling operation of a data processing apparatus on which the machine-readable code executes to perform a method for use with a gaming machine that is arranged to select symbols, present the selected symbols on a display in respective ones of a first plurality of symbol positions, and award an award if a winning outcome occurs, the method comprising:

receiving, by an acceptor that receives a physical item representing a monetary value, credit input by a player for contribution to a credit balance associated with the player, the credit balance stored by a hardware meter associated with the gaming system;

receiving, by the data processing apparatus, a wager input by the player using a player interface to initiate a gaming session;

displaying, by the data processing apparatus, the first plurality of symbol positions in successive arrays on a plurality of spinning reel columns each having a plurality of rows in a display area of the display, the respective first plurality of symbol positions each displaying a symbol that is drawn from a set of symbols that includes at least one special symbol, the at least one special symbol having a size that occupies an entire visible display area of at least one of the plurality of spinning reel columns;

determining, by the data processing apparatus, whether a displayed array satisfies an eligibility criterion, the eligibility criterion including a completed display of the entire at least one special symbol within the entire visible display area of at least one of the plurality of spinning reel columns;

when the displayed array satisfies the eligibility criterion, displaying, by the data processing apparatus, a resultant array by revealing a second plurality of symbol positions within the at least one spinning reel column obscured by one or more of the at least one special symbol in the displayed array, wherein revealing the second plurality of symbol positions obscured by the one or more of the at least one special symbol comprises progressively removing portions of the one or more of the at least one special symbol to reveal the second plurality of symbol positions obscured by the one or more of the at least one special symbol;

selecting, by the data processing apparatus, from the set of symbols, at least one symbol to be displayed in each of the revealed second plurality of symbol positions of the at least one spinning reel column in response to the second plurality of symbol positions being revealed; and crediting, by the data processing apparatus, the credit balance stored by the hardware meter and associated with the player with a payout if the symbols in the resultant array satisfy a winning criterion.

22. An electronic storage device for communicating with a game controller of a gaming system, the electronic storage device storing instructions readable and/or executable by the game controller to implement a method for use with the gaming system that is arranged to select symbols, present the selected symbols on a display in respective ones of a first plurality of symbol positions, and award an award if a winning outcome occurs, the method comprising:

receiving, by an acceptor that receives a physical item representing a monetary value, credit input by a player for contribution to a credit balance associated with the player, the credit balance stored by a hardware meter associated with the gaming system;

receiving, by the game controller, a wager input by the player using a player interface to initiate a gaming session;

activating, by the game controller, a plurality of reels to spin to present respective sequences of symbols in a display area of the display, each of the plurality of reels including a plurality of rows in the display area, at least one reel of the plurality of reels having an associated sequence that includes an oversized symbol having a size that occupies an entire visible display area of the at least one of the plurality of reels;

halting, by the game controller, the spinning reels to display the first plurality of symbol positions in an array in the display area, the respective first plurality of symbol positions each displaying a symbol that is drawn from a set of symbols that includes at least one oversized symbol;

determining, by the game controller, whether the displayed array satisfies an eligibility criterion, the eligibility criterion including a completed display of the entire at least one oversized symbol within the entire visible display area of the at least one of the plurality of reels;

when symbols in the array match the eligibility criterion, presenting, by the game controller, a resultant array by revealing a second plurality of symbol positions within the at least one reel obscured by the at least one oversized symbol in the display area, wherein revealing the second plurality of symbol positions obscured by the at least one oversized symbol comprises progressively removing portions of the at least one oversized symbol to reveal the second plurality of symbol positions obscured by the at least one oversized symbol; and crediting, by the game controller, the credit balance stored by the hardware meter and associated with the player with a payout if the symbols in the resultant array satisfy a winning criterion.

23. A non-transitory computer program product comprising machine-readable code recorded on a machine-readable medium, for controlling operation of a data processing apparatus on which the machine-readable code executes to perform a method for use with a gaming machine that is arranged to select symbols, present the selected symbols on a display in respective ones of a first plurality of symbol positions, and award an award if a winning outcome occurs, the method comprising:

receiving, by an acceptor that receives a physical item representing a monetary value, credit input by a player for contribution to a credit balance associated with the player, the credit balance stored by a hardware meter associated with the gaming system;

receiving, by the data processing apparatus, a wager input by the player using a player interface to initiate a gaming session;

activating, by the data processing apparatus, a plurality of reels to spin to present respective sequences of symbols in a display area of the display, each of the plurality of reels including a plurality of rows in the display area, at least one reel of the plurality of reels having an associated sequence that includes an oversized symbol having a size that occupies an entire visible display area of at least one of the plurality of reels;

halting, by the data processing apparatus, the spinning reels to display the first plurality of symbol positions in an array in the display area, the respective first plurality of symbol positions each displaying a symbol that is drawn from a set of symbols that includes at least one oversized symbol;

determining, by the data processing apparatus, whether the displayed array satisfies an eligibility criterion, the eligibility criterion including a completed display of the entire at least one oversized symbol within the entire visible display area of the at least one of the plurality of reels;

when symbols in the array match the eligibility criterion, presenting, by the data processing apparatus, a resultant array by revealing a second plurality of symbol positions within the at least one reel obscured by the at least one oversized symbol in the display area, wherein revealing the second plurality of symbol positions obscured by the at least one oversized symbol comprises progressively removing portions of the at least one oversized symbol to reveal the second plurality of symbol positions obscured by the at least one oversized symbol; and crediting, by the data processing apparatus, the credit balance stored by the hardware meter and associated with the player with a payout if the symbols in the resultant array satisfy a winning criterion.

* * * * *